US010144624B1

(12) United States Patent
Han et al.

(10) Patent No.: US 10,144,624 B1
(45) Date of Patent: Dec. 4, 2018

(54) MUTE HAND WINCH

(71) Applicant: Hangzhou Rock Machinery Manufacture Co., Ltd., Hangzhou (CN)

(72) Inventors: Minjie Han, Hangzhou (CN); Xinguang Yu, Hangzhou (CN)

(73) Assignee: HANGZHOU ROCK MACHINERY MANUFACTURE CO., LTD., Hangzhou (CN)

( * ) Notice: Subject to any disclaimer, the term of this patent is extended or adjusted under 35 U.S.C. 154(b) by 0 days.

(21) Appl. No.: 15/936,420

(22) Filed: Mar. 26, 2018

(51) Int. Cl.
*B66D 5/12* (2006.01)
*B66D 1/28* (2006.01)
*B66D 1/04* (2006.01)

(52) U.S. Cl.
CPC ..... *B66D 5/12* (2013.01); *B66D 1/04* (2013.01); *B66D 1/28* (2013.01); *B66D 2700/0183* (2013.01)

(58) Field of Classification Search
CPC ... B66D 5/12; B66D 5/22; B66D 1/04; B66D 1/28; B66D 2700/0183
See application file for complete search history.

(56) References Cited

U.S. PATENT DOCUMENTS

| | | | | |
|---|---|---|---|---|
| 5,573,091 | A * | 11/1996 | Hung | B66D 1/16 192/12 D |
| 6,695,292 | B2 * | 2/2004 | Nam | B66D 3/18 254/267 |
| 7,793,919 | B2 * | 9/2010 | Guyard | B66D 5/18 254/345 |
| 9,586,794 | B2 * | 3/2017 | Chung | B66D 1/30 |
| 2011/0062273 | A1 * | 3/2011 | Guyard | B66D 1/06 242/395 |

* cited by examiner

*Primary Examiner* — Michael E Gallion
(74) *Attorney, Agent, or Firm* — Perkins Coie LLP

(57) ABSTRACT

A mute hand winch includes a supporting system, a drive system and a braking system. The drive system includes a drive shaft, a capstan assembly and a first gear. Both the drive shaft and the capstan assembly are disposed at the base, the first gear is in threaded connection with the drive shaft, and the first gear is engaged with the capstan assembly. The braking system includes a second gear and a third gear. The second gear is sleeved on the drive shaft and is located at one side of the first gear. There is a gap between the first gear and the second gear. The first gear and the second gear are selectively attached and locked tightly to prevent the first gear and the capstan assembly from rotating. The third gear is fixed at the base, and the third gear has an unilateral bearing.

10 Claims, 6 Drawing Sheets

MUTE HAND WINCH

CROSS-REFERENCE TO RELATED APPLICATIONS

This Non-provisional application claims priority under 35 U.S.C. § 119(a) on Patent Application No(s). 201720651107.1 filed in Republic of China on Jun. 6, 2017, the entire contents of which are hereby incorporated by reference.

BACKGROUND OF THE INVENTION

Field of the Invention

This invention relates to a lifting device, and more particularly, to a mute hand winch.

Description of the Related Art

Currently, a hand winch on the market mainly includes a drive shaft assembly, a pinion assembly, a pawl, a ratchet assembly, a pawl shaft, a torsion spring and other components such as a gasket, a nut, a bolt and so on. The pinion assembly is installed at the drive shaft assembly and is engaged with the ratchet assembly such that the drive shaft assembly can drive the pinion assembly and the ratchet assembly to rotate in a clockwise direction and a counter-clockwise direction. The pawl is fixed at the pawl shaft and can be engaged with ratchet teeth of the ratchet assembly. During the operation of retracting the rope, the drive shaft drives the pinion assembly and the ratchet assembly to rotate. When the ratchet assembly rotates, the pawl is engaged with and inserted into the ratchet teeth of the ratchet assembly. This process will cause a lot of noise, which will undoubtedly lead to a bad operation environment, cause noise pollution, bring great trouble to the operation, and seriously affect the work and life of the surrounding people. This cannot meet the requirements of the development of environmental protection for modem people. In addition, since the ratchet assembly and the pawl often cause noise and vibration during the cooperation, the working frequency of the ratchet assembly and the pawl cannot be too high, which would restrict the working frequency of the hand winch to a certain extent, such that the operation efficiency is affected.

Further, the structure of the existing hand winch is rather complicated and is a single-pawl structure. The single-pawl structure is unsafe in braking as the force applied onto the ratchet assembly is not stable and will not efficiently prevent the ratchet assembly from rotating. This would bring the production operation a potential safety hazard. Particularly, when the pawl and the ratchet assembly undergo a certain amount of wear during use, heavy objects on the winch are easily to fall off due to the insufficient control of the pawl on the ratchet assembly, which will cause safety accidents.

BRIEF SUMMARY OF THE INVENTION

Since the winch in the prior art adopts a pawl and a ratchet assembly for breaking, a large noise is easily generated, which is bad for environmental protection and brings insecurity problems. One objective of this invention is to provide a mute hand winch to solve the above-mentioned problems.

To solve the above mentioned problems, this invention provides a mute hand winch. The mute hand winch includes a supporting system, a drive system and a braking system.

The supporting system includes a base. The drive system includes a drive shaft, a capstan assembly and a first gear. Both the drive shaft and the capstan assembly are disposed at the base, the first gear is in threaded connection with the drive shaft, and the first gear is engaged with the capstan assembly. The braking system includes a second gear and a third gear. The second gear is sleeved on the drive shaft and is located at one side of the first gear. There is a gap between the first gear and the second gear. When the first gear rotates and moves axially along the drive shaft to approach the second gear, the first gear and the second gear are attached and locked tightly to prevent the first gear and the capstan assembly from rotating. When the first gear rotates and moves axially along the drive shaft to be away from the second gear, the first gear and the second gear are separated to allow the first gear and the capstan assembly to rotate. The third gear is connected with the base, the third gear has an unilateral bearing, the unilateral bearing is disposed at the third gear such that the third gear can rotate in only one direction, and the second gear is engaged with the third gear.

According to one embodiment of the present invention, the number of the third gear may be two, and both the two third gears may are engaged with the second gear.

According to one embodiment of the present invention, the two third gears may be located in a same vertical line.

According to one embodiment of the present invention, the braking system may further include two third fixing assemblies. The two third gears may be connected with the base through the two third fixing assemblies, respectively. Each of the third fixing assemblies may include a pin shaft and a gasket, the pin shaft may go through the third gears and be fixed at the base, and the gasket may be sleeved on the pin shaft.

According to one embodiment of the present invention, the pin shaft may have a sleeve part, an interior of the gasket may have a waist-shaped hole, and a shape of the sleeve part may be the same as a shape of the waist-shaped hole such that the gasket is sleeved on the sleeve part.

According to one embodiment of the present invention, the braking system may further include a friction assembly, and the friction assembly may include two friction discs. The two friction discs may be attached to two side surfaces of the second gear, respectively.

According to one embodiment of the present invention, the base may include one bottom wall and two side walls, and the two side walls may be parallel and disposed at the bottom wall apart. The drive system may further include two first fixing assemblies, the two first fixing assemblies may be sleeved on both ends of the drive shaft, respectively, and the two first fixing assemblies may be respectively located on inner sides of the two side walls to prevent the drive shaft from moving axially.

According to one embodiment of the present invention, the first fixing assembly may include an axial circlip and a first shaft sleeve, the axial circlip may be attached to an inner surface of one side wall, and the first shaft sleeve may be attached to the axial circlip.

According to one embodiment of the present invention, the base may include one bottom wall and two side walls, and the two side walls may be parallel and disposed at the bottom wall apart. The drive system may further include two second fixing assemblies, the two second fixing assemblies may be sleeved on both ends of the drive shaft, respectively, and the two second fixing assemblies may be respectively located on outer sides of the two side walls to prevent the drive shaft from moving axially.

According to one embodiment of the present invention, each of the second fixing assemblies may include a second shaft sleeve, a gasket and a nut. The second shaft sleeve may be attached to an outer surface of one side wall, the gasket may be attached to the second shaft sleeve, and the nut may be attached to the gasket.

Compared with the prior art, this technical solution has the following advantages:

The third gear instead of the conventional ratchet and the pawl assembly is disposed at the base in this invention. The interior of the third gear is nested with an unilateral bearing. The one direction characteristic of the unilateral bearing realizes the one direction rotation of the third gear which achieves the same effect as the conventional pawl and ratchet assembly, while the third gear nested with the unilateral bearing avoids the noise problem caused in the conventional pawl and ratchet assembly braking process, which reduces the noise pollution and is more environmentally friendly.

In one embodiment, by disposing the two third gears at the base, the two third gears can be engaged with the second gear simultaneously to co-restrict the second gear to rotate only in one direction instead of rotating in the reverse direction. Therefore, this mute hand winch has more sufficient control force in braking process to assure the braking effect, and the mute hand winch is more safe and reliable, which reduces the risk of unforeseen accidents.

In one embodiment, by setting the third fixing assemblies, the third gears are disposed at the base. In addition, the gasket of the third fixing assembly is provided with a waist-shaped hole. The pin shaft of the third fixing assembly has a sleeve part matching with the waist-shaped hole such that the waist-shaped hole of the gasket can match with the sleeve part of the pin shaft well and fixedly, which can fix the third gears more stable and thus effectively assure the stability of the third gears.

In one embodiment, both sides of the second gear are provided with two friction discs. When the first gear approaches the second gear, the first gear can be attached to and locked more tightly with the second gear through the friction disc. Therefore, the first gear and the capstan assembly stop rotating, which further ensures that the mute hand winch obtains sufficient control force in the process of braking; in addition, by setting the friction discs, the wear of the second gear is reduced, and the service life of the second gear is prolonged.

DETAILED DESCRIPTION OF THE INVENTION

A technical solution of the present invention will be clearly and completely described below with reference to the accompanying drawings through specific embodiments.

Figure 1:
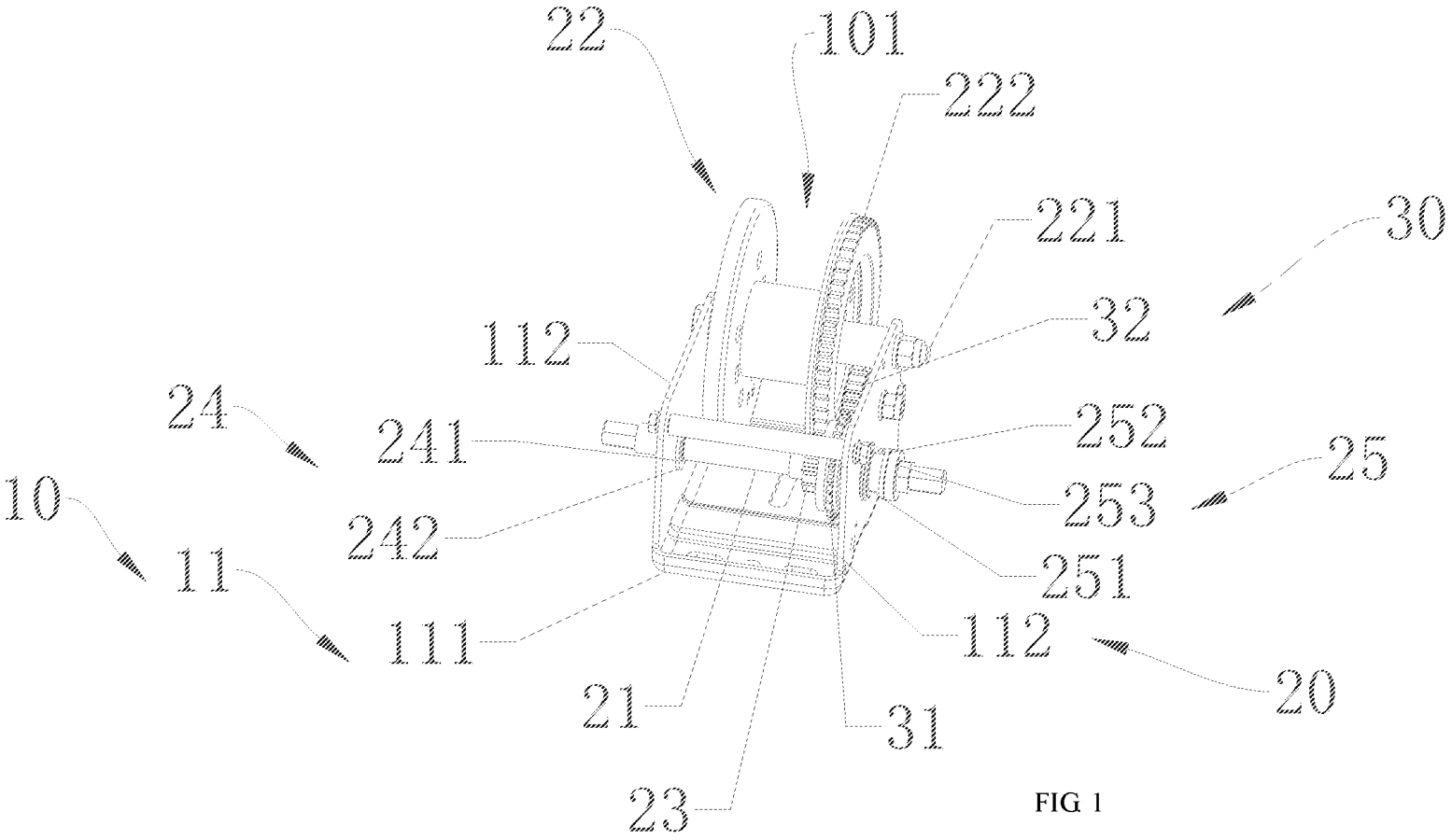
FIG. 1 is a schematic diagram of a three-dimensional structure of a mute hand winch in an embodiment of this invention.
Figure 2:
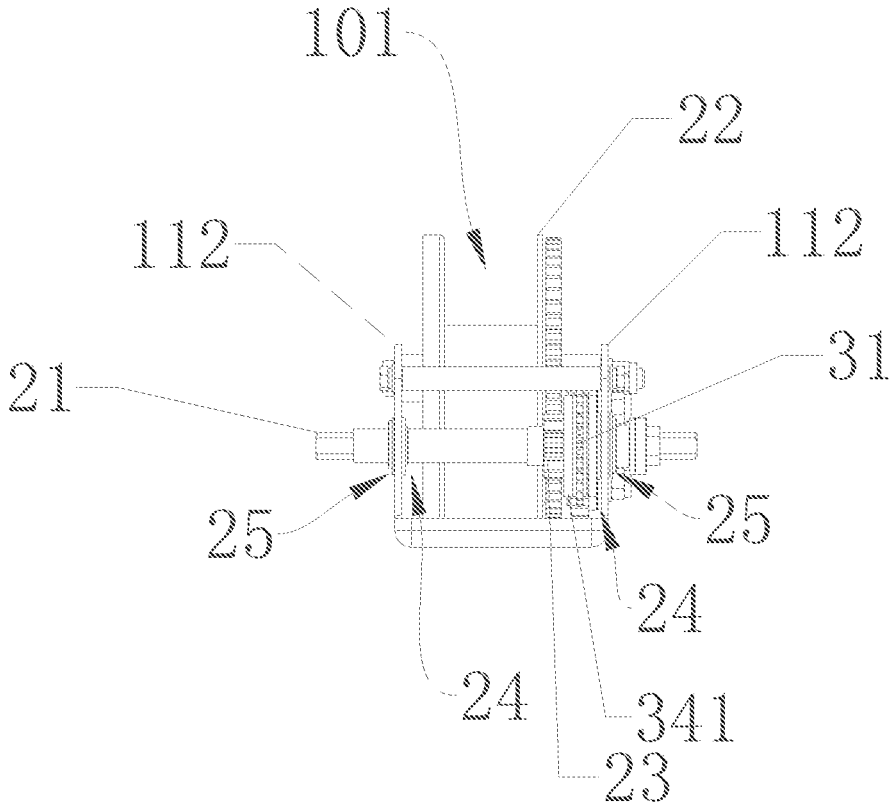
FIG. 2 is a top view of the mute hand winch in an embodiment of this invention.
Figure 3:
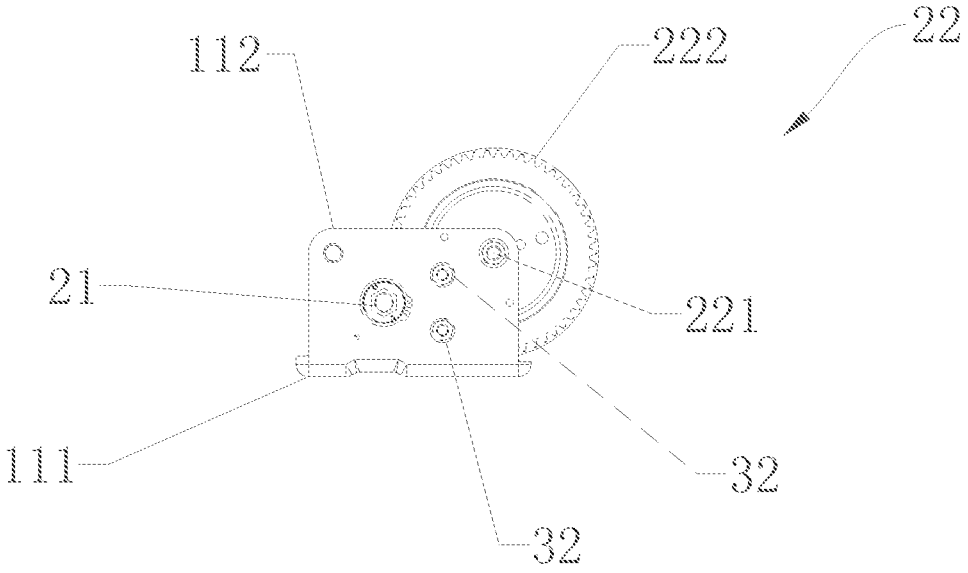
FIG. 3 is a side view of the mute hand winch in an embodiment of this invention.

Please refer to FIG. 1 to FIG. 3. This invention provides a mute hand winch which is used to retract or release a steel rope or a chain to lift or pull a heavy object. This application illustrates the structure and principle of the mute hand winch by taking an operation of retracting and releasing the steel rope as an example. The mute hand winch includes a supporting system 10, a drive system 20 and a braking system 30. The supporting system 10 as a supporting structure of the whole mute hand winch is used to support the mute hand winch. The drive system 20 is disposed at the supporting system 10 to be operated to achieve the operation of retracting and releasing the steel rope. The braking system 30 is disposed at the supporting system 10 for braking such that the drive system 20 stops running.

In order to explain the operation process of the mute hand winch and the cooperation between each part, in this application, the direction that each part of the mute hand winch rotates from outside to inside of a paper surface as shown in FIG. 1 is defined as a clockwise direction; conversely, the direction that each part of the mute hand winch rotates from inside to outside of the paper surface as shown in FIG. 1 is defined as a counterclockwise direction.

The supporting system 10 includes a base 11. The base 11 includes one bottom wall 111 and two side walls 112. The two side walls 112 are parallel to each other and disposed at two sides of the bottom wall 111 so as to form a storage gap 101 between the bottom wall 111 and the two side walls 112. In the process of use, the base 11 can be fixed at a supporting surface. For example, the bottom wall 111 can be fixed parallel to the ground, and the two side walls stand on the bottom wall 111, respectively. It should be noted that the base 11 may also be provided in other reasonable shapes to support and fix the mute hand winch. The structure of the base 11 in this embodiment is taken as an example and does not limit the scope of the present invention.

The drive system 20 is disposed at the supporting system 10. Specifically, the drive system 20 is fixed at the side wall 112 of the base 11. In the process of use, the steel rope is coiled around the drive system 20, and the operation of retracting and releasing the steel rope is achieved by the way of manual operation or a driving motor driving the drive system 20. The drive system 20 includes a drive shaft 21, a capstan assembly 22 and a first gear 23.

The drive shaft 21 is disposed at the base 11. As shown in FIG. 1, both ends of the drive shaft 21 are connected with the two side walls 112 respectively so that the drive shaft 21 can be driven to rotate around itself. Specifically the two side walls 112 has mounting holes, respectively. Both ends of the drive shaft 21 passes through the mounting holes on the two side walls 112 respectively so as to be fixed at the base 11. The drive shaft 21 has a thread. In the embodiment of this invention, one end of the drive shaft 21 is connected with a hand shank (not shown in FIG. 1). The drive shaft 21 can be driven by manual operating with the hand shank. Those skilled in the art may think that the drive shaft 21 can also be connected with an output end of a motor so as to be rotated by the motor driving the drive shaft 21.

Further, to strengthen the fixed connection between the drive shaft 21 and the base 11 to prevent the drive shaft 21 from falling off from the side wall 112 during the rotation process due to axial movement, the drive system 20 further includes two first fixing assembly 24. Two first fixing assemblies 24 are sleeved on both ends of the drive shaft 21 respectively to prevent the drive shaft 21 from axial moving. The two first fixing assemblies 24 are located at an inside surface of the two side walls 112 respectively such that the drive shaft 21 can only rotate in a radial direction.

Both the two first fixing assemblies 24 are attached to inner surfaces of the two side walls 112, respectively. The first fixing assembly 24 includes an axial circlip 241 and a first shaft sleeve 242. Refer to FIG. 1. The first shaft sleeve 242 is attached to the inner surface of the side wall 112, and the axial circlip 241 is attached to the first shaft sleeve 242. It is understandable that by disposing the axial circlip 241 and the first shaft sleeve 242, axial movement of the drive shaft 21 toward the inside of the side wall 112 is prevented.

Furthermore, the drive system 21 further includes two second fixing assemblies 25. The two second fixing assembly 25 are sleeved on both end of the drive shaft 21 respectively and are located at an outer surface of the two side walls 112. In the same way, the second fixing assembly 25 can play a role of preventing the drive shaft 21 from the axial movement.

The two second fixing assemblies 25 are attached to outer surfaces of the two side walls 112, respectively. The second fixing assembly 25 includes a second shaft sleeve 251, a gasket 252 and a nut 253. As shown in FIG. 1, the second shaft sleeve 251 is attached to the outer surface of the side wall 112, the gasket 252 is attached to the second shaft sleeve 251, and the nut 253 is attached to the gasket 252. It is understandable that by disposing the second shaft sleeve 251, the gasket 252 and the nut 253, the axial movement of the drive shaft 21 toward the outside of the side wall 112 is prevented.

It is worth mentioning that in the embodiment of this invention, the drive system 20 includes two first fixing assemblies 24 and two second fixing assemblies 25 such that both ends of the drive shaft 21 are sleeved on one first fixing assembly 24 and one second fixing assembly 25. The first fixing assembly 24 and the corresponding second fixing assembly 25 are attached to the inner surface and the outer surface of the side wall 112, respectively. The side wall 112 is located between the first fixing assembly 24 and the corresponding second fixing assembly 25. Such design has a double protection effect which can ensure that the drive shaft 21 will not have relatively large axial placement and will not fall off from the side wall 112. Those skilled in the art may think that in other embodiment, the drive system 20 could only include two first fixing assemblies 24 while leaving out the second fixing assembly 25; or the drive system 20 could only include two second fixing assemblies 25 while leaving out the first fixing assembly 24. In this way, it can also play a role of preventing the drive shaft 21 from falling off from the side wall 112.

The capstan assembly 22 is disposed at the base 11. As shown in FIG. 1, both ends of the capstan assembly 22 are correspondingly connected with the two side walls 112 of the base 11, respectively. The capstan assembly 22 has a fixation shaft 221 extending transversely. Two ends of the fixation shaft 221 are fixed correspondingly at the two side walls 112 of the base 11, respectively. Two ends of the fixation shaft 221 extend transversely from both sides of the capstan assembly 22. One side of the capstan assembly 22 has a gear 222.

The first gear 23 is sleeved on the drive shaft 21. The first gear 23 is located at the drive shaft 21 near the gear 222. The first gear 23 is in threaded connection with the drive shaft 21. Specifically, an interior of the first gear 23 has a threaded hole. There is a thread located at the corresponding position of the drive shaft 21 such that the first gear 23 is sleeved on the drive shaft 21 in a threaded connecting way. Thus the first gear 23 can move along the thread of the drive shaft 21, that is to say, the first gear 23 can move in the axial direction along the drive shaft 21 in the state of being rotated relative to the drive shaft 21.

As shown in FIG. 1 and FIG. 2, the drive shaft 21 and the capstan assembly 22 are parallel to each other and are fixed at the two side walls 112 of the base 11 apart. The first gear 23 is engaged with the gear 222 of the capstan assembly 22. It is understandable that the positions of the drive shaft 21 and the capstan assembly 22 are rationally set such that the first gear 23 is engaged with the capstan assembly 22. When the drive shaft 21 is driven to rotate in the radial direction, the drive shaft 21 drives the first gear 23 to rotate, and the first gear 23 drives the capstan assembly 22 to rotate.

The braking system 30 includes a second gear 31 and at least one third gear 32. The second gear 31 is sleeved on the drive shaft 21.The second gear 31 is located at one side of the first gear 23. There is a gap between the second gear 31 and the first gear 23. Selectively, the gap between the second gear 31 and the first gear 2 is set to be 1 mm. When the first gear 23 rotates and moves axially along the drive shaft 21 to approach the second gear 31, the first gear 23 and the second gear 31 are engaged and locked tightly so as to prevent the first gear 23 and the capstan assembly 22 from rotating; and when the first gear 23 rotates and moves axially along the drive shaft 21 to be away from the second gear 31, the first gear 23 and the second gear 31 disengage so as to allow the first gear 23 and the capstan assembly 22 to rotate.

Figure 6:
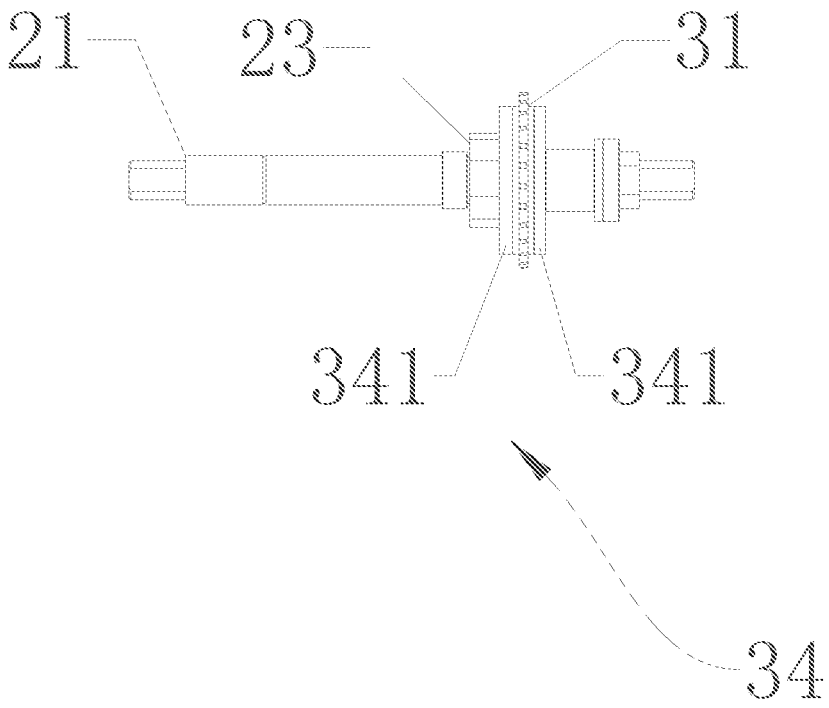
FIG. 6 shows a connecting way between a friction assembly and the second gear of the mute hand winch in an embodiment of this invention.

Specifically, as shown in FIG. 1 and FIG. 6, the second gear 31 is located between the first gear 23 and one of the side walls 112. One side surface of the second gear 31 is attached to one of the side wall 112. The other side surface of the second gear 31 is selectively attached to the first gear 23. As the first gear 23 is in threaded connection with the drive shaft 21, the first gear 23 can be driven to move axially along the drive shaft 21 to approach or be away from the second gear 31 during the process of use. When the first gear 23 approaches to the second gear 31, the first gear 23 is attached to one side surface of the second gear 31. When the first gear 23 is away from the second gear 31, the first gear 23 is separated from one side surface of the second gear 31. By this way, the first gear 23 can be selectively attached to the second gear 31 to achieve braking and prevent the drive system 20 from rotating.

The third gear 32 is connected with the base 11. Specifically, the third gear 32 is connected with one of the side walls 112 of the base 11. The third gear 32 is engaged with the second gear 31 such that the third gear 32 and the second gear 31 mutually restrict each other. As shown in FIG. 1, the third gear 32 is connected with the inner surface of one side wall 112 and can rotate around its own central axis. The third gear 32 is located between one side wall 112 and the gear 222 of the capstan assembly 22. It is understandable that the gear 222 of the capstan assembly 22, the first gear 23, the second gear 31 and the third gear 32 are all located at one side of the base 11. The third gear 32 is set to rotate in one direction only, that is, the third gear 32 is allowed to rotate in one direction only. When there is a reverse rotation trend, the third gear 32 is locked tightly and cannot move. Therefore, when the second gear 31 rotates in one direction, it can drive the third gear 32 to rotate accordingly; conversely, when the second gear 31 has a reverse rotation trend, as the third gear 32 cannot rotate reversely, the third gear 32 restricts and locks the second gear 31 tightly such that the second gear 31 cannot rotate.

Figure 4:
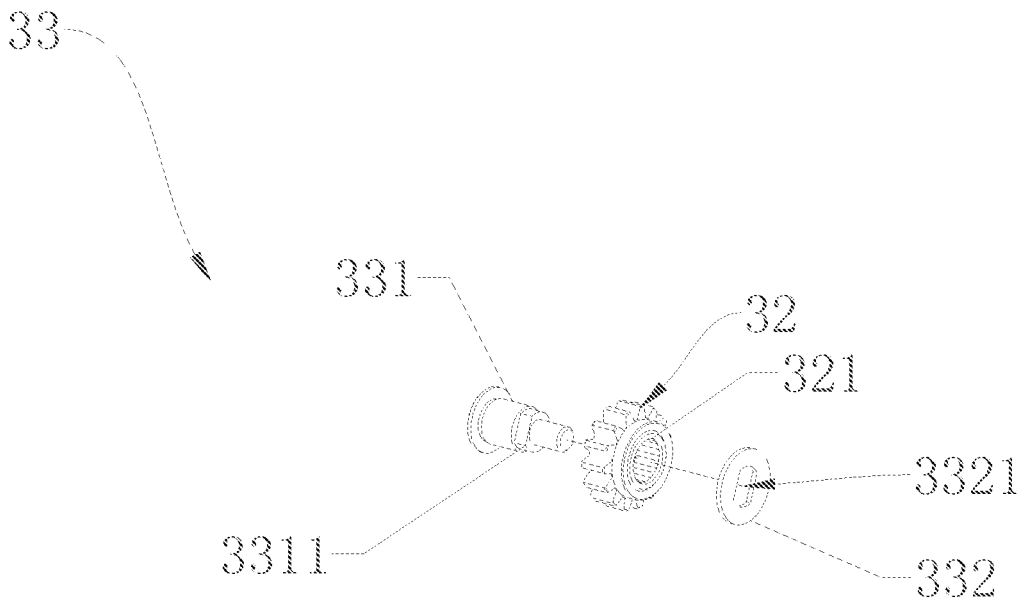
FIG. 4 is a schematic diagram of an exploded structure of a third gear and a third fixing assembly of the mute hand winch in an embodiment of this invention showing a connecting way between the third gears and the third fixing assembly.

As shown in FIG. 4, the third gear 32 includes an unilateral bearing 321. The unilateral bearing 321 is nested inside the third gear 32. The unilateral bearing 321 can rotate in one direction only. Therefore based on unilateral rotation characteristics of the unilateral bearing 321, the third gear 32 with the function of unilateral rotation is achieved.

Figure 5:
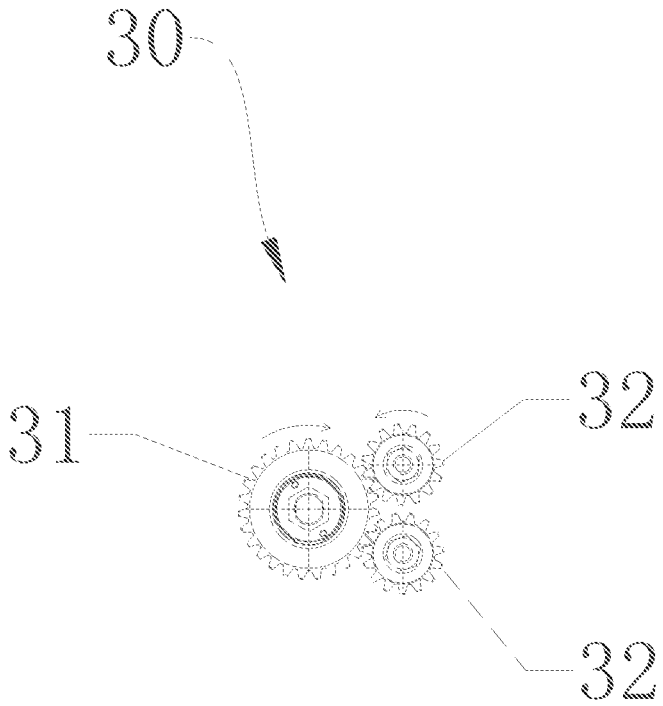
FIG. 5 shows an engaging mode of the two third gears and a second gear of the mute hand winch in an embodiment of this invention.

In the embodiment of this invention, the third gear 32 can rotate only in the counterclockwise direction and cannot rotate in the clockwise direction. Therefore, as shown in FIG. 5, when the second gear 31 rotates in the clockwise direction, the second gear 31 drives the third gear 32 to rotate in the counterclockwise direction; and when the second gear 31 has a trend of rotating in the counterclockwise direction, as the third gear 32 cannot rotate in the clockwise direction and is locked tightly, the third gear 32 further restricts and locks the second gear 31 such that the second gear 31 does not move either.

Further, the braking system 30 also includes at least one third fixing assembly 33. The third fixing assembly 33 is used to fix the third gear 32 at the side wall 112 of the base 11. In other words, the third gear 32 is connected with the side wall 112 by the third fixing assembly 33. The third fixing assembly 33 includes a pin shaft 331 and a gasket 332. The pin shaft 331 passes through the third gear 32 and is fixed at the side wall 112 of the base 11. The gasket 332 is sleeved on the pin shaft 331 as to prevent the third gear 32 from loosening and falling off.

Particularly, as shown in FIG. 3 and FIG. 4, the pin shaft 331 has a sleeve part 3311. The interior of the gasket 332 has a waist-shaped hole 3321, and the shape of the sleeve part 3311 matches with the shape of the waist-shaped hole 3321 such that the pin shaft 331 passes through the waist-shaped hole 3321 in the gasket 332. The gasket 332 is sleeved on the sleeve part 3311 of the pin shaft 331. That is to say, the gasket 332 is positioned and locked at the sleeve part 3311 of the pin shaft 331. The advantage of this design is that the waist-shaped hole 3321 of the gasket 332 matches with the sleeve part 3311 such that the gasket 332 is not easy to fall off from the pin shaft 331, thus the fixing and locking function of the pin shaft 331 and the gasket 332 to the third gear 32 is strengthened.

Furthermore, in the embodiment of this invention, the braking system 30 includes two third gears 32. That is to say, the number of the third gear 32 is two. Correspondingly, the braking system 30 includes two third fixing assemblies 33, that is, the number of the third fixing assembly 33 is two.

Thus, the two third gears 32 are correspondingly connected with the side wall 112 through the two fixing assemblies 33, respectively. As shown in FIG. 3 and FIG. 5, both the two third gears 32 are engaged with the second gear 31. The two third gears 32 are located in a same vertical line, that is, the two third gears 32 are located at the same side of the second gear 31 and arranged at the same vertical line. Thus, the two third gears 32 rotate synchronously in the same direction. Two third gears 32 and the second gear 31 mutually restrict against each other.

Specifically, as shown by the arrow in FIG. 5, when the second gear 31 rotates in the clockwise direction, it drives the two third gears 32 simultaneously to rotate synchronously in the counterclockwise direction; and when the second gear 31 tends to rotate in the counterclockwise direction, both the two third gears 32 cannot rotate in the clockwise direction and are locked tightly such that the two third gears 32 co-restrict and lock the second gear 31 tightly so as to make the second gear 31 not rotate.

Furthermore, the braking system 30 further includes a friction assembly 34. The friction assembly 34 is disposed at the second gear 31 as to protect the second gear 31 and reduce the friction loss on the second gear 31. As shown in FIG. 6, the friction assembly 34 includes two friction discs 341. Two friction discs 341 are attached to both sides of the second gear 31 to reduce the friction loss between the second gear 31 and first gear 23, and reduce the friction loss between the second gear 31 and the side wall 112.

When the first gear 23 is driven to move along the drive shaft 21 in the axial direction to approach the second gear 23, the first gear 23 is attached to the friction disc 341 which is located at one side of the second gear 31. In addition, through the friction action created between the first gear 23 and the friction disc 341, the first gear 23 and the second gear 31 are pressed together and locked tightly. When the first gear 23 is driven to move along the drive shaft 21 in the axial direction to be away from the second gear 31, the first gear 23 is separated from the friction disc 341 located at one side of the second gear 31. The friction between the first gear 23 and the friction disc 341 disappears. A gap between the first gear 23 and the second gear 31 is created, and the two are no longer attached and locked tightly, such that the first gear 23 and the second gear 31 can rotate freely again.

In the operation process of the mute hand winch, when retracting the steel rope operation is required, the drive shaft 21 is driven to rotate in the clockwise direction, and meanwhile the drive shaft 21 drives the first gear 23 and second gear 31 to rotate synchronously in the clockwise direction. As the first gear 23 is engaged with the gear 222 of the capstan assembly 22, the second gear 31 is engaged with the two third gears, respectively. Therefore the first gear 23 drives the capstan assembly 22 to rotate synchronously in the counterclockwise direction, while the second gear 31 drives the two third gears 32 to rotate synchronously in the counterclockwise direction. In such a way, with the counterclockwise rotation of the capstan assembly 22, the retracting the steel rope operation is achieved, and the steel rope (not shown in the drawing) is coiled around the capstan assembly 22 gradually.

When the braking is required in the process of retracting the steel rope, one end of the steel rope is loaded with a heavy object, that is, the mute hand winch is in a state of load. Stop driving the drive shaft 21 and the drive shaft 21 is stopped such that the first gear 23, the second gear 31 and the third gear 32 all stop rotating in succession. At this time, since one end of the steel rope carries the heavy object, the heavy object exerts a force on the capstan assembly 22 through the steel rope under its own weight. The force makes the capstan assembly 22 rotate in the clockwise direction, then the capstan assembly 22 drives the first gear 23 to rotate in the counterclockwise direction. It is understandable that the first gear 23 will move along the drive shaft 21 in the axial direction to approach the second gear 32 as the drive shaft 21 stops rotating at this moment. And then the first gear 23 is attached to the friction disc 341 through a friction force, thus to achieve the first gear 23 and the second gear 31 being locked tightly with no movement.

When releasing the steel rope operation is required, the drive shaft 21 is driven to rotate in the counterclockwise direction. The first gear 23 is driven by the drive shaft 21 to rotate synchronously in the counterclockwise direction. At this moment, the second gear 31 tends to rotate synchronously in the counterclockwise direction. However, due to the characteristics of one direction rotation of the two third gears 32, the two third gears 32 cannot rotate in the clockwise direction and are locked tightly. Therefore the two third gears 32 restrict and lock the second gear 31 tightly. That is to say, the drive shaft 21 only drives the first gear 23 to rotate synchronously in the counterclockwise direction, while the second gear 31 and two third gears 32 keep immovable. The first gear 23 further drives the capstan assembly 22 to rotate in the clockwise direction. In such a way, with the clockwise rotation of the capstan assembly 22, the releasing the steel rope operation is achieved, and the steel rope (not shown in the drawing) is released from the capstan assembly 22 gradually.

Similarly, when the braking is required in the process of releasing the steel rope, one end of the steel rope is loaded with a heavy object, and the mute hand winch is in a state of load. Stop driving the drive shaft 21 and the drive shaft 21 is stopped such that the first gear 23 stops rotating. The heavy object exerts a force on the capstan assembly 22 through the steel rope under its own weight, such that the force makes the capstan assembly 22 rotate in the clockwise direction, then the capstan assembly 22 drives the first gear 23 to rotate in the counterclockwise direction. It is understandable that the first gear 23 will move along the drive shaft 21 in the axial direction to approach the second gear 32 as the drive shaft 21 stops rotating at this moment. And then the first gear 23 is attached to the friction disc 341 through a friction force, thus to achieve the first gear 23 and the second gear 31 being locked tightly with no movement.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A mute hand winch comprising:

a supporting system comprising a base;

a drive system comprising a drive shaft, a capstan assembly and a first gear, wherein both the drive shaft and the capstan assembly are disposed at the base, the first gear is in threaded connection with the drive shaft, and the first gear is engaged with the capstan assembly; and a braking system comprising a second gear and a third gear, wherein the second gear is sleeved on the drive shaft and is located at one side of the first gear, there is a gap between the first gear and the second gear, when the first gear rotates and moves axially along the drive shaft to approach the second gear, the first gear and the second gear are attached and locked tightly to prevent the first gear and the capstan assembly from rotating, when the first gear rotates and moves axially along the drive shaft to be away from the second gear, the first gear and the second gear are separated to allow the first gear and the capstan assembly to rotate, the third gear is connected with the base, the third gear has an unilateral bearing, the unilateral bearing is disposed at the third gear such that the third gear is capable of rotating only in one direction, and the second gear is engaged with the third gear.

2. The mute hand winch according to claim 1, wherein the number of the third gear is two, and both the two third gears are engaged with the second gear.

3. The mute hand winch according to claim 2, wherein the two third gears are located in a same vertical line.

4. The mute hand winch according to claim 2, the braking system further comprising two third fixing assemblies, wherein the two third gears are connected with the base through the two third fixing assemblies, respectively, each of the third fixing assemblies comprises a pin shaft and a gasket, the pin shaft passes through the third gears and is fixed at the base, and the gasket is sleeved on the pin shaft.

5. The mute hand winch according to claim 4, wherein the pin shaft has a sleeve part, an interior of the gasket has a waist-shaped hole, and a shape of the sleeve part matches with a shape of the waist-shaped hole such that the gasket is sleeved on the sleeve part.

6. The mute hand winch according to claim 1, the braking system further comprising a friction assembly, the friction assembly comprising two friction discs, and the two friction discs are attached to two side surfaces of the second gear, respectively.

7. The mute hand winch according to claim 1, wherein the base comprises one bottom wall and two side walls, the two side walls are parallel and disposed at the bottom wall apart, the drive system further comprises two first fixing assemblies, the two first fixing assemblies are sleeved on both ends of the drive shaft, respectively, and the two first fixing assemblies are respectively located on inner sides of the two side walls to prevent the drive shaft from moving axially.

8. The mute hand winch according to claim 7, wherein each of the first fixing assemblies comprises an axial circlip and a first shaft sleeve, the axial circlip is attached to an inner surface of one side wall, and the first shaft sleeve is attached to the axial circlip.

9. The mute hand winch according to claim 1, wherein the base comprises one bottom wall and two side walls, the two side walls are parallel and disposed at the bottom wall apart, the drive system further comprises two second fixing assemblies, the two second fixing assemblies are sleeved on both ends of the drive shaft, respectively, and the two second fixing assemblies are respectively located on outer sides of the two side walls to prevent the drive shaft from moving axially.

10. The mute hand winch according to claim 9, wherein each of the second fixing assemblies comprises a second shaft sleeve, a gasket and a nut, the second shaft sleeve is attached to an outer surface of one side wall, the gasket is attached to the second shaft sleeve, and the nut is attached to the gasket.

* * * * *